US007515117B2

(12) United States Patent
Moon

(10) Patent No.: US 7,515,117 B2
(45) Date of Patent: Apr. 7, 2009

(54) DRIVING METHOD FOR PLASMA DISPLAY PANEL

(75) Inventor: Seong-Hak Moon, Seoul (KR)

(73) Assignee: LG Electronics Inc., Seoul (KR)

( * ) Notice: Subject to any disclaimer, the term of this patent is extended or adjusted under 35 U.S.C. 154(b) by 528 days.

(21) Appl. No.: 11/069,942

(22) Filed: Mar. 3, 2005

(65) Prior Publication Data

US 2005/0195134 A1 Sep. 8, 2005

(30) Foreign Application Priority Data

Mar. 5, 2004 (KR) ..... 10-2004-0015138

(51) Int. Cl.
*G09G 3/28* (2006.01)

(52) U.S. Cl. ..... 345/60; 345/37; 345/41; 345/67

(58) Field of Classification Search ..... 345/60, 345/67, 41, 37
See application file for complete search history.

(56) References Cited

U.S. PATENT DOCUMENTS 4,426,646 A * 1/1984 Yamaguchi et al. ..... 345/62
5,369,338 A * 11/1994 Kim ..... 315/169.4
6,252,568 B1 * 6/2001 Iseki et al. ..... 345/60
6,559,814 B1 * 5/2003 Kanazawa et al. ..... 345/60
6,559,815 B1 * 5/2003 Kang et al. ..... 345/60
2002/0135545 A1 * 9/2002 Akiba ..... 345/60
2005/0195135 A1 * 9/2005 Moon ..... 345/67
2006/0187148 A1 * 8/2006 Kwak et al. ..... 345/67
2008/0143643 A1 * 6/2008 Moon ..... 345/60

FOREIGN PATENT DOCUMENTS

EP 1 065 650 A2 1/2001
EP 1 227 465 A2 7/2002

OTHER PUBLICATIONS

Yoo, Jun-Young, et al.; "P-65: High Speed-Addressing Method for Single-Scan of AC PDP," Digital Display Research Lab., LG Electronics Inc., Seoul, Korea, SID 01 Digest, Jun. 3, 2001, pp. 798-801 (XP-007007865).
European Search Report dated Aug. 24, 2006.

* cited by examiner

*Primary Examiner*—Bipin Shalwala
*Assistant Examiner*—Afroza Y Chowdhury
(74) *Attorney, Agent, or Firm*—Ked & Associates LLP

(57) ABSTRACT

Provided is a driving method for a plasma display panel capable of prolonging a life span of the plasma display panel and improving luminous efficiency thereof by preventing an accumulation of positive charges on an address electrode of the plasma display panel. For the purpose in the present invention, voltage pulses having different polarities and sizes are applied to a pair of sustain electrodes of a plasma display panel while sustaining a discharge for the plasma display panel.

12 Claims, 4 Drawing Sheets

DRIVING METHOD FOR PLASMA DISPLAY PANEL

BACKGROUND OF THE INVENTION

1. Field of the Invention

The present invention relates to a driving method for a plasma display panel (PDP), and particularly, to a driving method for a plasma display panel capable of improving luminous efficiency thereof and prolonging a life span thereof.

2. Description of the Conventional Art

A general plasma display panel (PDP) is typically a display in which ultraviolet rays generated by the discharge of inactive gas, which is obtained by mixing helium (He) and xenon (Xe) or neon (Ne) and xenon (Xe), excite phosphors to realize images including texts or graphics. The plasma display panel is characterized by facilitating its scale-up, and providing a superior image quality and a fast response speed. Also, since the plasma display panel is possible to be thin, it attracts attention as a wall-mounted display together with a field emission display, a thin film transistor liquid crystal display, or the like.

A monochromatic plasma display panel device directly uses visible rays emitted from a discharge gas in order to display images. There may, for instance, be a PDP using orange rays given out from a neon (Ne) gas. In case that full color is required to be displayed, the PDP uses visible rays generated by allowing ultraviolet rays generated from the discharge gas such as krypton (Kr) or Xenon (Xe) to excite phosphors for red (R), green (G), and blue (B).

The plasma display panel is a display device using a discharge of gas so as to be also called as a gas discharge display device.

The plasma display panel is classified depending on types of the discharge into a DC type, an AC type, or a hybrid type. The DC type has characteristics that an electrode used for applying a voltage supplied from the external to form the plasma is directly exposed to the plasma and thus a conduction current directly flows through the electrode. The AC type has characteristics that the electrode is covered with a dielectric not to be directly exposed to the plasma and thus a displacement current flows through the electrode.

Also, the plasma display panel may also be classified depending on how the electrode is arranged into an opposed discharge type, a surface discharge type, a barrier discharge type, or the like. In particular, as an example of the surface discharge type, a three-electrode surface discharge type alternating current plasma display panel is comprised of: sustain electrodes located in parallel at a lower portion of a same upper glass substrate; an upper substrate including a dielectric covering the sustain electrodes; and a lower substrate placed at an upper portion of the lower glass substrate, having a certain interval by a barrier structure, and including an address electrode which is formed to be intersected with the sustain electrodes in its vertical direction. The discharge gas is sealed in a space between the upper and lower substrates and the barrier structure is sealed. In the three-electrode surface discharge type alternating current plasma display panel, wall charges are accumulated on the surface of the dielectric which covers the sustain electrodes during the discharge for the display panel, and displays data using memory characteristics by the accumulated wall charge.

Hereinafter, with reference to FIGS. 1 through 3, it will be explained a sustain discharge driving method by illustrating the general three-electrode surface discharge type alternating current plasma display panel.

FIG. 1 briefly shows discharge cells in the general three-electrode surface discharge type alternating current plasma display panel.

Referring to FIG. 1, a single discharge cell of the general three-electrode surface discharge type alternating current plasma display panel (hereinafter, the plasma display panel) is comprised of: two sustain electrodes (Y electrode and Z electrode) located on the same surface, address electrode (X electrode) vertically intersecting with the sustain electrodes, and phosphor placed between the sustain electrodes and the address electrode.

FIG. 2 shows operational waveforms applied to each electrode while sustaining a discharge for the general plasma display panel based on the conventional art.

FIG. 3 shows charges formed on each electrode while sustaining the discharge for the general plasma display panel based on the conventional art.

As shown in FIG. 2, in the conventional sustain discharge driving method for the general plasma display panel, the sustain discharge is performed by alternately applying a first predetermined positive voltage pulse Vsy and a second predetermined positive voltage pulse Vsz to the discharge sustain electrodes (Y sustain electrode and Z sustain electrode). In response to this, as shown in FIG. 3, positive charges are always accumulated in the address electrode (X electrode) without regard to the first and second predetermined positive voltage pulses Vsy and Vsz applied to the Y sustain electrode and the Z sustain electrode while sustaining the discharge for the plasma display panel based on the conventional art.

However, when sustaining the discharge, if the positive charges are accumulated on the address electrodes (X electrodes), particles of the electrodes come off by an impact between phosphors of the discharge cell and positive ions cling to the inside of the wall of the discharge cell, which results in degrading luminous efficiency of the plasma display panel and enhancing aging of the phosphors. As a result, the plasma display panel disadvantageously has had a shorter life span.

SUMMARY OF THE INVENTION

Therefore, an object of the present invention is to provide a driving method for a plasma display panel capable of prolonging a life span of the plasma display panel and improving luminous efficiency thereof by preventing an accumulation of positive charges in address electrodes by means of applying voltage pulses having different polarities and sizes to each sustain electrode of a pair of sustain electrodes while sustaining a discharge of the plasma display panel.

To achieve these and other advantages and in accordance with the purpose of the present invention, as embodied and broadly described herein, there is provided a driving method for a plasma display panel in which, when sustaining a discharge for the plasma display panel, voltage pulses having different polarities and sizes are applied to a pair of sustain electrodes of the plasma display panel.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Reference will now be made in detail to the preferred embodiments of the present invention, examples of which are illustrated in the accompanying drawings.

With reference to FIGS. 4 through 7, it will be explained in detail of a driving method for a plasma display panel capable of prolonging a life span of the plasma display panel and improving luminous efficiency thereof by preventing an accumulation of positive charges on address electrodes by means of applying voltage pulses having different polarities and sizes to each sustain electrode of a pair of sustain electrodes, when sustaining a discharge of the plasma display panel.

An apparatus for performing the driving method for the plasma display panel according to the present invention preferably includes a sustain electrode driver which can drive sustain electrodes (Y electrode and Z electrode) by applying positive or negative voltage pulses (i.e., sustain discharge pulse). The sustain electrode driver includes a plurality of switching units which are controlled by a switching control signal inputted from the external, and a driving voltage controller capable of controlling positive or negative driving voltages inputted to the sustain electrodes. The plurality of switching units apply the sustain discharge pulses to the sustain electrodes (Y electrode and Z electrode) depending on the switching control signal, and the sustain discharge pulses are generated by a separate sustain discharge pulse circuit to be applied to the sustain electrodes (Y electrode and Z electrode).

Figure 4:
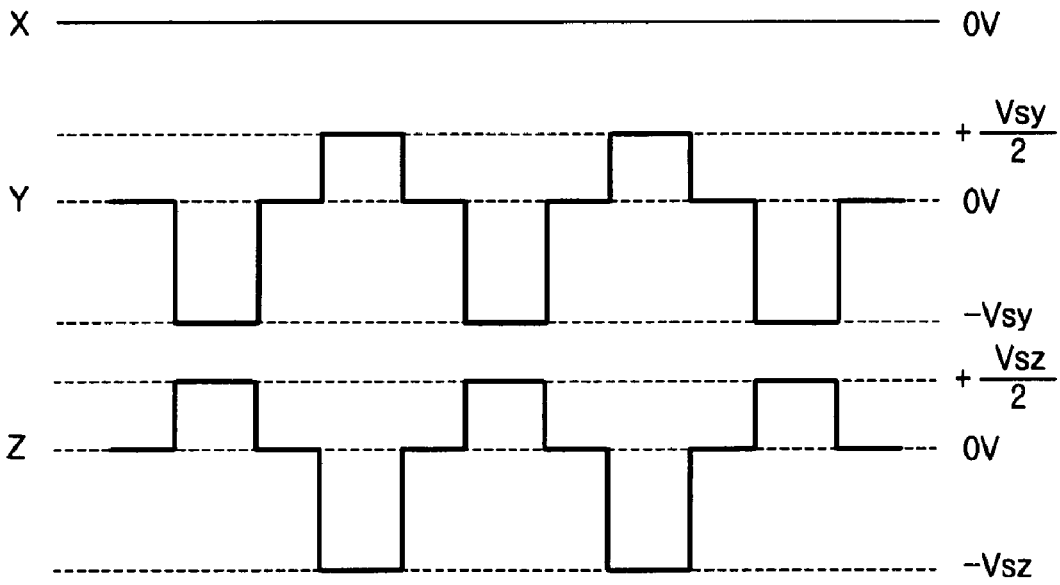
FIG. 4 shows waveforms of sustain discharge pulses applied to each electrode in a sustain discharge in accordance with an embodiment of the driving method for the plasma display panel of the present invention.
Figure 5:
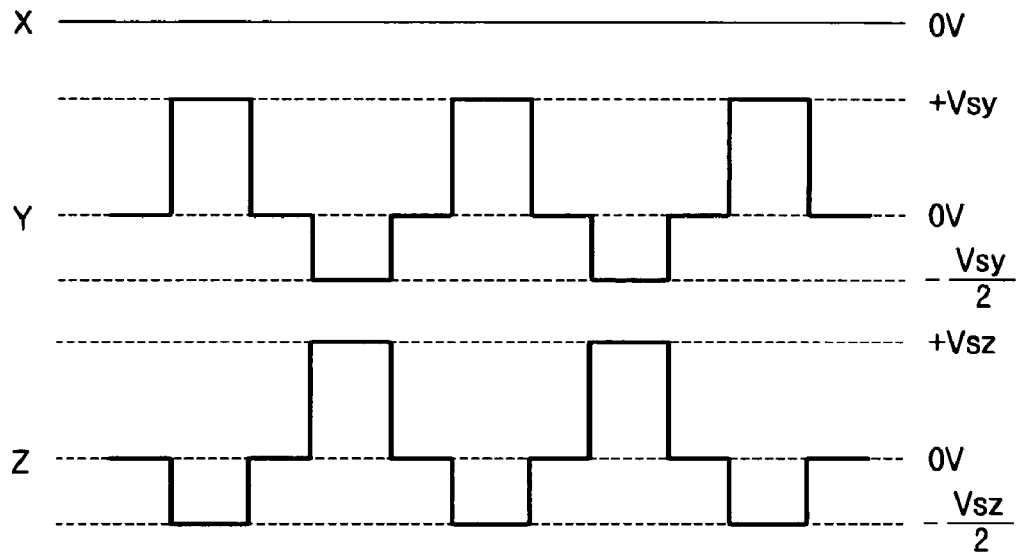
FIG. 5 shows waveforms of sustain discharge pulses applied to each electrode in the sustain discharge in accordance with an embodiment of the driving method for the plasma display panel of the present invention.

FIGS. 4 and 5 show waveforms of the sustain discharge pulses applied to each electrode while sustaining the discharge in an embodiment of the driving method for the plasma display panel according to the present invention.

Referring to FIGS. 4 and 5, in the embodiment of the driving method for the plasma display panel according to the present invention, when sustaining the discharge for the plasma display panel, a positive voltage pulse and a negative voltage pulse (i.e., sustain discharge pulse) are alternately applied to the sustain electrodes (Y electrode and Z electrode) of a discharge cell. During this, the positive voltage pulse and the negative voltage pulse applied to each sustain electrode have different sizes from each other. The waveforms of the sustain discharge pulses as shown in FIG. 4 correspond to a case where the positive voltage pulse has a size smaller than that of the negative voltage pulse, while the waveforms of the sustain discharge pulses as shown in FIG. 5 correspond to a case where the positive voltage pulse has a size greater than that of the negative voltage pulse.

Figure 1:
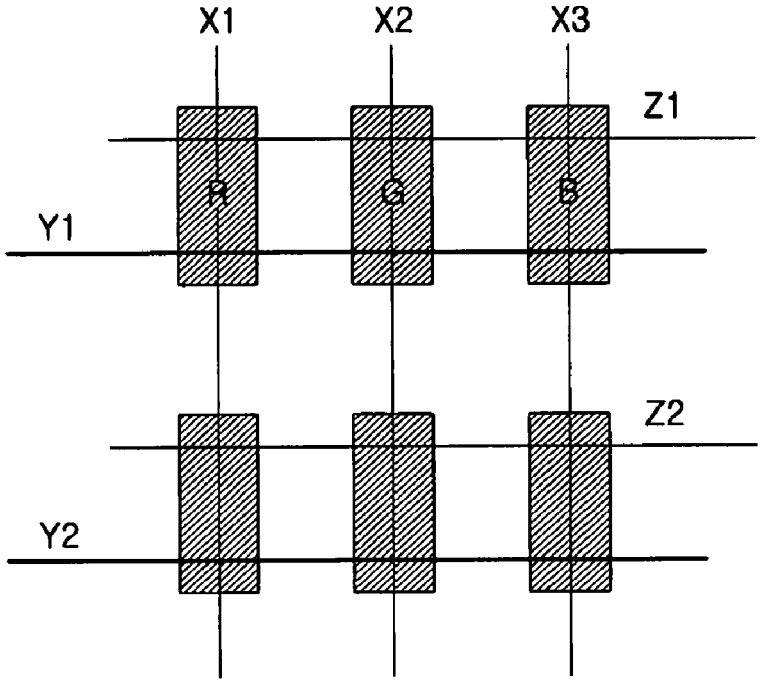
FIG. 1 CONVENTIONAL ART
FIG. 1 briefly shows a discharge cell in the general three-electrode surface discharge type alternating current plasma display panel.
Figure 2:
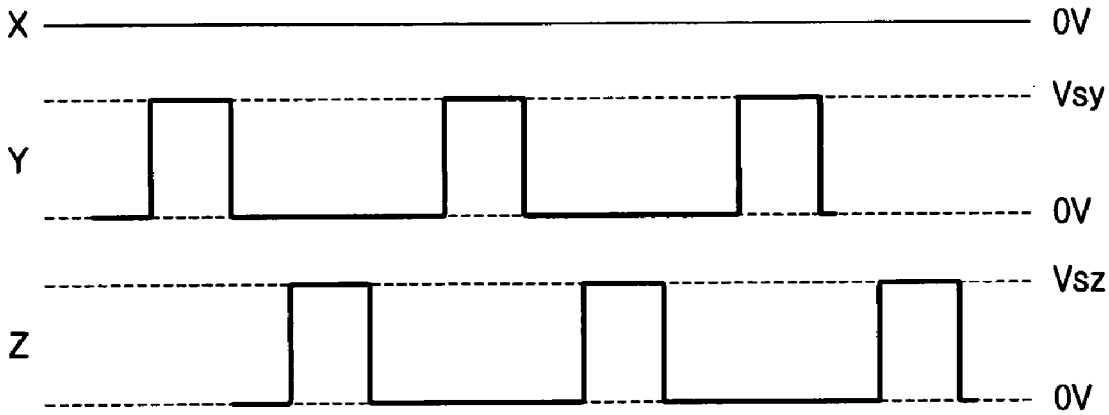
FIG. 2 CONVENTIONAL ART
FIG. 2 shows operational waveforms applied to each electrode while sustaining a discharge for the general plasma display panel based on the conventional art.
Figure 3:
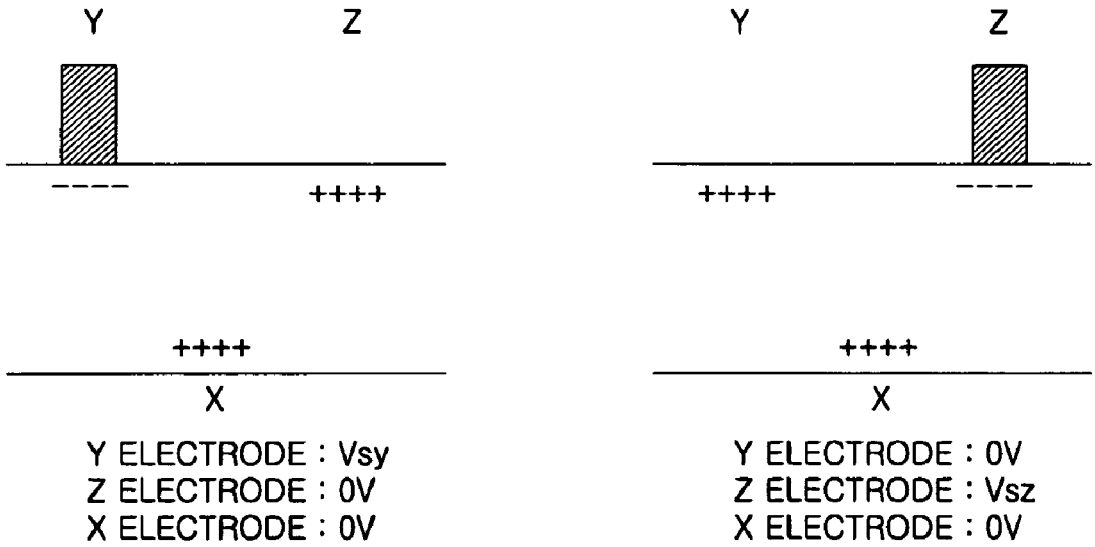
FIG. 3 CONVENTIONAL ART
FIG. 3 shows charges formed on each electrode while sustaining the discharge for the general plasma display panel based on the conventional art.

The positive voltage pulse and the negative voltage pulse applied to the Y sustain electrode and the positive voltage pulse and the negative voltage pulse applied to the Z sustain electrode may have the ratio of sizes therebetween of 1:2 shown in FIG. 4 or 2:1 shown in FIG. 5. That is, as shown in FIG. 4, the Y sustain electrode receives the voltage pulses of −Vsy and $$+\frac{Vsy}{2},$$

and the Y sustain electrode receives the voltage pulses of $$+\frac{Vsz}{2}$$

and −Vsz. Also, as shown in FIG. 5, the Y sustain electrode receives the voltage pulses of +Vsy and $$-\frac{Vsy}{2},$$

and the Z sustain electrode receives the voltage pulses of $$-\frac{Vsz}{2}$$

and +Vsz.

Here, the voltage pulses applied to the sustain electrodes (Y electrode and Z electrode) may be generated by including a voltage-multiplication circuit in the sustain voltage pulse circuit of the sustain electrode driver (not shown) which drives the sustain electrodes (Y electrode and Z electrode). That is, in case of applying a high voltage, the applied voltage of $$\pm\frac{Vsy}{2} \text{ or } \pm\frac{Vsz}{2}$$

is changed to ±Vsy or ±Vsz through the voltage-multiplication circuit and then applied to the sustain electrodes. While, in case of applying a low voltage, the applied voltage $$\pm\frac{Vsy}{2} \text{ or } \pm\frac{Vsz}{2}$$

is directly applied to the sustain electrodes.

Here, as aforementioned, instead of establishing the ratio of sizes of the sustain voltage pulses as 1:2 or 2:1, if constructing a circuit in which the size of the applied voltage is optionally controlled and outputted, the ratio of sizes of the positive voltage pulse and the negative voltage pulse applied to each sustain electrode can be controlled optionally.

Now, the embodiments of the driving method for the plasma display panel according to the present invention will be described in more detail.

Still referring to FIG. 4, in the driving method for the plasma display panel according to the present invention, a negative voltage pulse is applied to the Y sustain electrode of a discharge cell and simultaneously a positive voltage pulse is applied to the Z sustain electrode during a first predetermined time. Then, a ground voltage is simultaneously applied to both the Y and Z sustain electrodes during a second predetermined time. Afterwards, the positive voltage pulse is applied to the Y sustain electrode and simultaneously the negative voltage pulse is applied to the Z sustain electrode during the first predetermined time.

Also, still referring to FIG. 5, in the driving method for the plasma display panel according to the present invention, after a positive voltage pulse is applied to the Y sustain electrode of a discharge cell and simultaneously a negative voltage pulse is applied to the Z sustain electrode during a first predetermined time, a ground voltage is applied to both the Y and Z sustain electrodes during a second predetermined time. Afterwards, the negative voltage pulse is applied to the Y sustain electrode and simultaneously the positive voltage pulse is applied to the Z sustain electrode.

Hereinafter, a distribution of charges accumulated on address electrodes (X electrodes) in accordance with an embodiment of the driving method for the plasma display panel of the present invention will be explained with reference to FIGS. 6 and 7.

Figure 6:
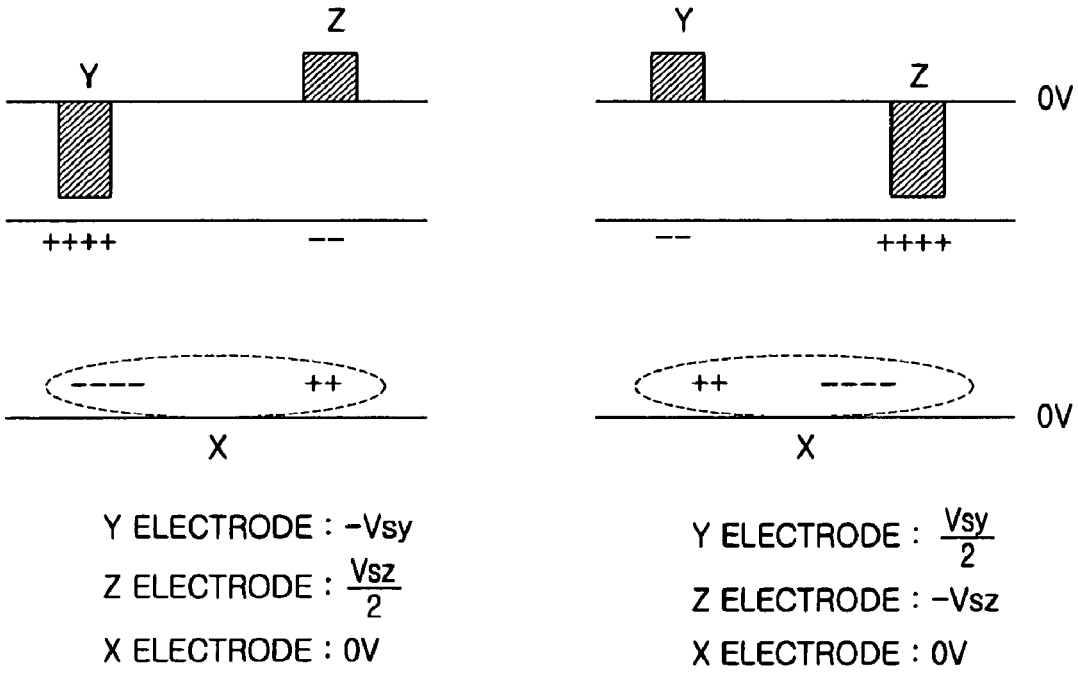
FIG. 6 shows charges accumulated on each electrode of the plasma display panel when applying sustain discharge pulses to sustain electrodes as shown in FIG. 4.

FIG. 6 shows charges accumulated on each electrode of the plasma display panel when applying sustain discharge pulses to the sustain electrodes as shown in FIG. 4.

FIG. 6 shows the case where the size of the negative voltage pulse applied to the Y and Z sustain electrodes is greater than that of the positive voltage pulse applied thereto, whereas the charges accumulated on the address electrode (X electrode) are negative charges. In other words, as shown in FIG. 4, once applying the discharge sustain voltage pulse to the sustain electrodes, the negative charges relatively more than the positive charges are accumulated on the address electrode (X electrode) by the negative voltage pulse which is greater than the positive voltage pulse. On the other hand, the positive charges less than the accumulated negative charges are accumulated, which results in accumulating the negative charges on the whole.

Figure 7:
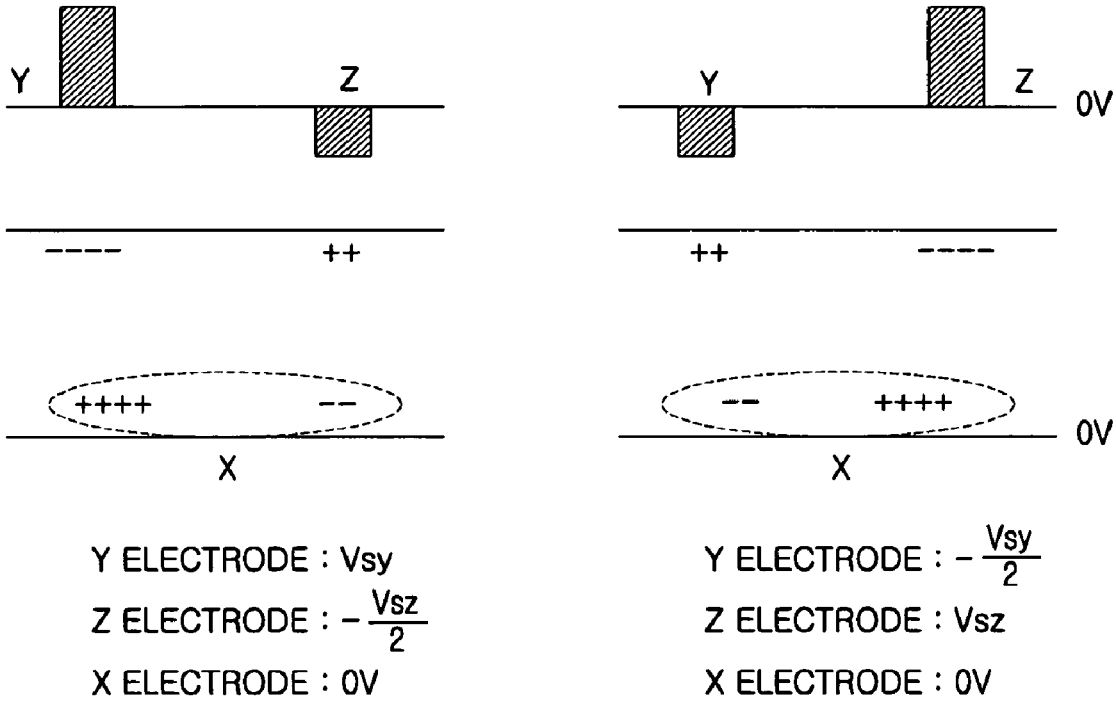
FIG. 7 shows charges accumulated on each electrode of the plasma display panel when applying sustain discharge pulses to the sustain electrodes as shown in FIG. 5.

FIG. 7 shows charges accumulated on each electrode of the plasma display panel when applying the sustain discharge pulses to the sustain electrodes as shown in FIG. 4.

FIG. 7 shows the case where the size of the positive voltage pulse applied to the Y and Z sustain electrodes is greater than that of the negative voltage pulse applied thereto. That is, the charges accumulated to the address electrode (X electrode) are positive charges but the amount of the positive charges accumulated on the address electrodes in the embodiment according to the present invention is less than the amount of the positive charges accumulated on the address electrodes in the conventional driving method. As a result, the influence on the phosphors by the accumulated positive charges can be reduced.

As another embodiment, both the two driving methods shown in FIGS. 4 and 5 may be carried out and used together. For instance, among the discharge cells of the plasma display panel, the discharge cells in an odd field drive the sustain electrodes by the driving method shown in FIG. 4 and the discharge cells in an even field drive the sustain electrodes by the driving method shown in FIG. 5. According to this, the charges accumulated on the address electrodes can be neutralized. That is, the negative charges are accumulated on the address electrodes in the odd field, and the positive charges are accumulated on the address electrodes in the even field such that the positive and the negative charges are altogether offset and neutralized.

As described so far, in the present invention, when sustaining the discharge of the plasma display panel, the positive charges are prevented from being accumulated on the address electrodes by applying voltage pulses having different polarities and sizes to a pair of sustain electrodes of the plasma display panel. As a result, it is effective to prolong the life span of the plasma display panel and improve luminous efficiency thereof.

Furthermore, in the driving method for the plasma display panel according to the present invention, when sustaining the discharge, the negative voltage pulse is used as the sustain discharge pulse, such that a rising time and a falling time of the pulse become fast to effectively reduce a reactive power.

In addition, in the driving method for the plasma display panel according to the present invention, both the negative and positive voltage pulses are used altogether as the sustain discharge pulse while sustaining the discharge. As a result, it is effective to lower the sustain discharge driving voltage.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. A driving method for a plasma display panel, comprising:

applying a first series of pulses to a first sustain electrode of the plasma display panel, wherein the first series of pulses include a first positive polarity pulse and a first negative polarity pulse; and applying a second series of pulses to a second sustain electrode of the plasma display panel, wherein the second series of pulses include a second negative polarity pulse and a second positive polarity pulse, wherein a voltage level of the first negative polarity pulse applied to the first sustain electrode is greater than a voltage level of the first positive polarity pulse applied to the first sustain electrode, and a voltage level of the second negative polarity pulse applied to the second sustain electrode is greater than a voltage level of the second positive polarity pulse applied to the second sustain electrode.

2. The method of claim 1, wherein applying the first and second series of pulses comprises:

sequentially applying the first negative polarity pulse and the first positive polarity pulse to the first sustain electrode while sequentially applying the second positive polarity pulse and the second negative polarity pulse to the second sustain electrode respectively, when the first and second sustain electrodes are applied in an odd field; and sequentially applying the second positive polarity pulse and the second negative polarity pulse to the second sustain electrode while sequentially applying the first negative polarity pulse and the first positive polarity pulse to the first sustain electrode respectively, when the first and second sustain electrodes are applied in an even field.

3. The method of claim 1, wherein applying the first and second series of pulses comprises:

applying the first negative polarity pulse to the first sustain electrode during a first predetermined time while applying the second positive polarity pulse to the second sustain electrode during the first predetermined time;

applying a ground voltage to the first and second sustain electrodes during a second predetermined time; and applying the first positive polarity pulse to the first sustain electrode during the first predetermined time while applying the second negative polarity pulse to the second sustain electrode during a third predetermined time.

4. The method of claim 3, wherein the voltage level of the first negative polarity pulse is two times greater than the voltage level of the first positive polarity pulse, and the voltage level of the second negative polarity pulse is two times greater than the second positive polarity pulse.

5. A driving method for a plasma display panel, comprising:

applying a first series of pulses to a first sustain electrode while sustaining a discharge of the plasma display panel, wherein the first series of pulses include a first positive polarity pulse and a first negative polarity pulse; and applying a second series of pulses having opposite polarities from those of the first series of pulses to a second sustain electrode while sustaining the discharge of the plasma display panel, wherein:

a voltage level of the first negative polarity pulse applied to the first sustain electrode is greater than a voltage level of the first positive polarity pulse applied to the first sustain electrode, and a voltage level of the second negative polarity pulse applied to the second sustain electrode is greater than a voltage level of the second positive polarity pulse applied to the second sustain electrode.

6. The method of claim 5, wherein the first negative polarity pulse is applied to the first sustain electrode while applying the second positive polarity pulse to the second sustain electrode, and the first positive polarity pulse is applied to the first sustain electrode while applying the second negative polarity pulse to the second sustain electrode.

7. The method of claim 5, wherein the voltage level of the first negative polarity pulse applied to the first sustain electrode in an odd field is greater than the voltage level of the second positive polarity pulse applied to the second sustain electrode in the odd field when the first and second electrodes are sustain electrodes of discharge cells in the odd field; and wherein the voltage level of the first negative polarity pulse applied to the first sustain electrode in an even field is smaller than the voltage level of the second positive polarity pulse applied to the second sustain electrode in the even field when the first and second sustain electrodes are sustain electrodes of discharge cells in the even field.

8. A driving method for a plasma display panel, comprising:

applying a positive polarity pulse to at least one sustain electrode of the plasma display panel; and applying a negative polarity pulse to the at least one sustain electrode of the plasma display panel, wherein a voltage level of a first negative polarity pulse applied to a first sustain electrode is greater than a voltage level of a first positive polarity pulse applied to the first sustain electrode, and wherein a voltage level of a second negative polarity pulse applied to a second sustain electrode is greater than a voltage level of a second positive polarity pulse applied to the second sustain electrode.

9. The method of claim 8, wherein the voltage levels of the first and second negative polarity pulses are larger than voltage levels of the first and second positive polarity pulses, respectively, when the panel is driven in an odd field mode.

10. The method of claim 1, wherein the first positive polarity pulse is applied opposite to the second negative polarity pulse and the second positive polarity pulse is applied opposite to the first negative polarity pulse.

11. A driving apparatus for a plasma display panel, comprising:

a first electrode driver configured to apply a first pulse to a first sustain electrode of the plasma display panel, wherein the first pulse has a first positive polarity pulse and a first negative polarity pulse; and a second electrode driver configured to apply a second pulse to a second sustain electrode of the plasma display panel, wherein the second pulse has a second negative polarity pulse and a second positive polarity pulse and an opposite polarity to those of the first pulse, wherein a voltage level of the first negative polarity pulse applied to the first sustain electrode is greater than the voltage level of the first positive polarity pulse applied to the first sustain electrode, and the voltage level of the second negative polarity pulse applied to the second sustain electrode is greater than the voltage level of the second positive polarity pulse applied to the second sustain electrode.

12. A driving apparatus for a plasma display panel, comprising:

a first electrode driver configured to a first pulse to a first sustain electrode of a pair of sustain electrodes while sustaining a discharge of the plasma display panel, wherein the first pulse has a positive polarity pulse and a first negative polarity pulse; and a second electrode driver configured to apply a second pulse having opposite polarities from those of the first pulse to a second sustain electrode of the pair of sustain electrodes while sustaining the discharge of the plasma display panel, wherein a voltage level of the first negative polarity pulse applied to the first sustain electrode is greater than the voltage level of the first positive polarity pulse applied to the first sustain electrode, and the voltage level of the second negative polarity pulse applied to the second sustain electrode is greater than the voltage level of the second positive polarity pulse applied to the second sustain electrode.

* * * * *